United States Patent [19]

Taguchi et al.

[11] Patent Number: 5,050,788

[45] Date of Patent: Sep. 24, 1991

[54] DISPENSING CARTON FOR A ROLL FILM

[75] Inventors: Takashi O. Taguchi, Ohomiya; Akio Ouchi, Katsuta; Mitsunobu Uchida, Tokyo, all of Japan

[73] Assignee: Kureha Chemical Industry Company, Limited, Tokyo, Japan

[21] Appl. No.: 480,840

[22] Filed: Feb. 16, 1990

[30] Foreign Application Priority Data

Feb. 21, 1989 [JP] Japan ..... 1-40550

[51] Int. Cl.[5] ..... B65D 85/67

[52] U.S. Cl. ..... 225/25; 225/48

[58] Field of Search ..... 225/25, 50, 43, 48, 225/49

[56] References Cited

U.S. PATENT DOCUMENTS

| | | | |
|---|---|---|---|
| 3,549,066 | 12/1970 | Wankow | 225/25 |
| 3,845,894 | 11/1974 | Merlin | 225/25 |
| 3,974,947 | 8/1976 | Budny | 225/25 |
| 4,307,828 | 12/1981 | Sias et al. | 225/25 |
| 4,534,497 | 8/1985 | Neale | 225/25 |

*Primary Examiner*—Douglas D. Watts

*Assistant Examiner*—John M. Husar

*Attorney, Agent, or Firm*—Koda and Androlia

[57] ABSTRACT

A dispensing carton containing film wound cylindrically includes an adhesive retaining device which retains the leading edge of the film left after the film pulled out from a carton box has been cut by a cutter. The retaining device includes a base member, a sticking layer mounted on one surface of the base member to fix the base member on the surface of the front panel and an adhesive layer mounted on the other surface of the base member. The adhesive layer is formed of grafted copolymer obtained by graft-polymerizing vinyl chloride monomer with copolymer of ethylene and vinylacetate. Preferably, the adhesive layer is formed of grafted copolymer obtained by graft-polymerizing vinyl chloride monomer having weight ratio of 80–20 with copolymer of ethylene and vinylacetate having weight ratio of 20–80 in which the weight ratio of ethylene and vinylacetate is 20–70 to 80–30. Further, the surface of the adhesive layer is partially covered by a resin layer to reduce the surface area of the adhesive layer for retaining the film.

6 Claims, 3 Drawing Sheets

DISPENSING CARTON FOR A ROLL FILM

BACKGROUND OF THE INVENTION

The present invention relates to a dispensing carton which can contain a roll film for wrapping foodstuffs and can be used to cut the film to dispense it.

More particularly, the dispensing carton of the present invention comprises a means for preventing a leading edge of a wrapping film pulled out from the carton from being wound back into the carton. The means can retain the pulled-out film by adhering to the film in such a way that the adhered film can be separated therefrom and no paper or fiber of paper will be adhered to the means. However, the means can repeatedly adhere to the film.

Film for wrapping foodstuffs is wound on a core cylindrically and contained in a carton. The wrapping film is pulled out from the carton by a desired length and is cut by a cutter provided in the carton. At this time, in order to prevent the leading edge of the wrapping film which has been left on the outside of the carton from being wound back or pulled back into the carton, an adhesively retaining dot is mounted on an outer surface of a carton body made of paper to retain the wrapping film. A conventional carton provided with the adhesively retaining dot of this type is disclosed in, for example, U.S. Pat. No. 4,307,828.

It is necessary that the adhesively retaining dot mounted on the carton can retain the leading edge of the film pulled out from the carton detachably. However, the adhesively retaining dot must not adhere to the film with tack so that very large force is required to separate the film from the dot and must not adhere to the film with so much tack that the film will be broken when the film is separated from the dot. Further, it is not preferable that the retaining dot retains others such as fiber of paper or dust except the wrapping film. If the dot which can retain fiber of paper is used, fiber of paper which is material of a front flange of the carton will be peeled off from the surface of paper and will adhere to the surface of the dot when the wrapping film is separated from the dot and the front flange of the carton comes into contact with the dot. Further, dust in the air has a tendency to adhere to the surface of the dot. When fiber of paper or dust adheres to the dot, the retaining force of the film by the dot is not only deteriorated as it ages but also the fiber attached to the dot is transferred to the film, causing hygienic problem when foodstuff is wrapped by the film.

In addition, if the retaining member has much tack, fiber of paper which is material of the front flange adheres to the retaining member when the carton is not opened for use and the front flange is closed. In U.S. Pat. No. 4,307,828, in order to prevent paper from adhering to the retaining member, an adhesive surface protecting sheet is provided on the inner surface of the front flange so that the sheet is in contact with the retaining member. In this manner, when the adhesive surface protecting sheet is provided, a process of manufacturing the carton is complicated correspondingly.

It is an object of the present invention to provide a dispensing carton provided with a retaining device which can retain a leading edge of a wrapping film so that the leading edge is not wound back into the carton and does not have tack which is so strong that others such as fiber of paper and dust except the film adhere to the retaining device but has tack which is moderate so that the retaining device can retain and is released from the film many times repeatedly.

It is another object of the present invention to provide a dispensing carton provided with a retaining device in which a contact area between an adhesive surface of the retaining device and a wrapping film can be set properly so that the wrapping film can be retained with moderate force.

SUMMARY OF THE INVENTION

According to the present invention, a dispensing carton containing a film wound cylindrically comprises a box including a bottom panel, a rear panel, a front panel and both sides panels, a lid member joined to the rear panel to cover an upper opening of the box, a cutter for cutting the film pulled out from the opening, and adhesively retaining means provided on a front surface of the front panel on which the film left after the pulled-out film has been cut by the cutter hangs. The retaining means comprises a base member, a sticking layer mounted on a rear surface of the base member to fix the base member on the surface of the front panel and an adhesive layer mounted on a surface of the base member. The adhesive layer is formed of grafted copolymer obtained by graft-polymerizing vinyl chloride monomer with copolymer of ethylene and vinylacetate. Preferably, the adhesive layer is formed of grafted copolymer obtained by graft-polymerizing vinyl chloride monomer having weight ratio of 80–20 with copolymer of ethylene and vinylacetate having weight ratio of 20–80 in which the weight ratio of ethylene and vinylacetate is 20–70 to 80–30. The adhesive layer retains the leading edge of the wrapping film left after the pulled-out film has been cut with moderate force and even after the adhesive layer adheres to or is released from the film many times repeatedly, the adhesive layer can maintain the adhesive force or the retaining force thereof. It is difficult that fiber of paper or dust adheres to the surface of the adhesive layer. Further, the surface of the adhesive layer can be covered by a resin layer partially so that a contact area between the adhesive layer and the wrapping film can be reduced to adjust the force of retaining the film moderately.

DETAILED DESCRIPTION OF PREFERRED EMBODIMENT

A dispensing carton for a roll film according to an embodiment of the present invention is provided with an adhesively retaining device attached to the surface of a front panel of the carton. An adhesive surface of the retaining device possesses tack which is moderate so that the adhesive surface can adhere to a leading edge of the pulled-out wrapping film adhesively and is released from it repeatedly. Material of the adhesive surface is formed of grafted copolymer obtained by graft-polymerizing vinyl chloride monomer with copolymer of ethylene and vinylacetate. The adhesive surface of the grafted copolymer possesses low tack and the film retaining force of the adhesive surface is about 50 grams per 25 mm or less for the wrapping film (for example, trade name "KREWRAP" of Kureha Chemical Industry Company) made of vinylidene chloride (a measuring method of the retaining force will be described later). The force is sufficient to retain the leading edge of the film left after cut by a cutter provided in the carton so that the leading edge of the film is not wound back into the carton. If the film retaining force exceeds about 50 grams per 25 mm, there is a possibility that the wrapping film is broken when the film is peeled off from the retaining device. Further, when the film retaining force is larger than the above value, it is not preferable because fiber of paper or the like adheres to the adhesive surface. the adhesive surface formed of grafted copolymer has the retaining force which is not weakened even if the adhesive surface adheres to and is released from the wrapping film many times repeatedly. Accordingly, the adhesive surface can retain the film many times repeatedly.

Figure 1:
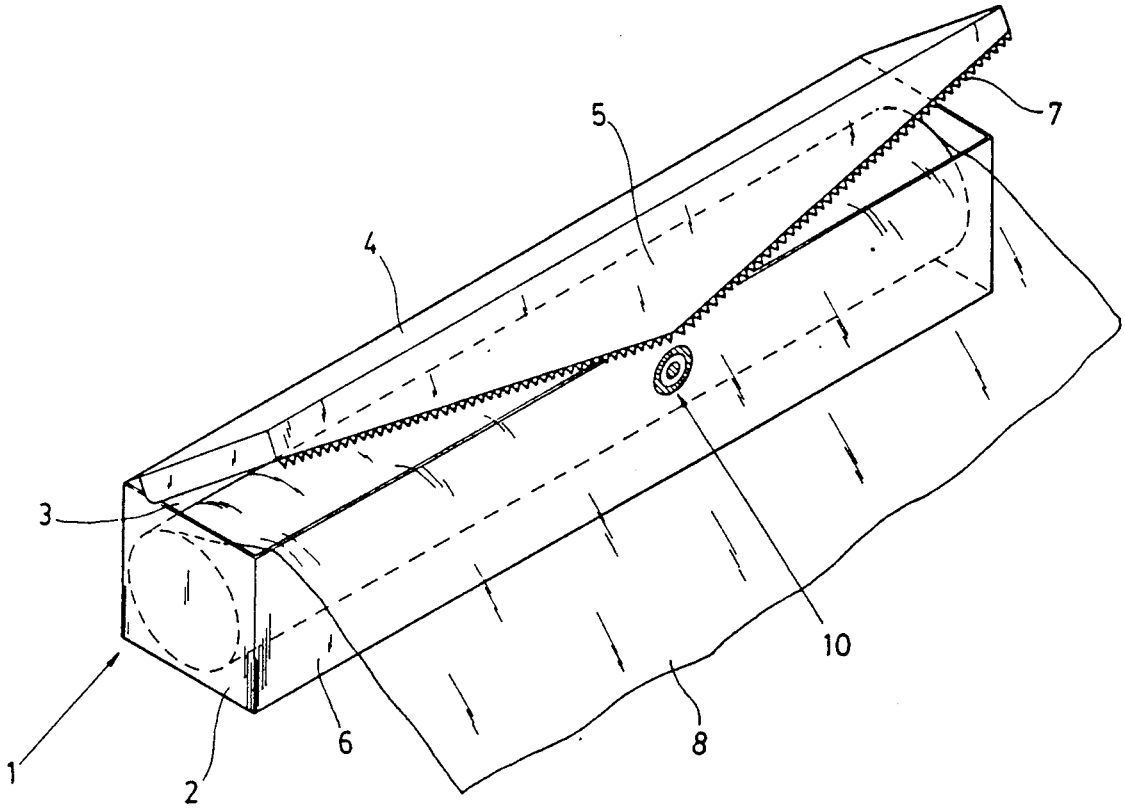
FIG. 1 is a perspective view showing a dispensing carton for a wrapping film according to the present invention.

In FIG. 1, reference numeral 1 denotes a dispensing carton. The carton 1 comprises a box 2 made of paper and a lid member 4 which covers an opening 3 formed in the upper portion of the box 2. The lid member 4 is formed continuously to the box 2 and can cover the opening 3. A front flange 5 is continuously formed in the end of the lid member 4 and the front flange 5 is overlapped on the front surface of a front panel 6 of the box 2 when the lid member 4 is closed. Further, the end of the front flange 5 is formed into a V-shape and the V-shaped portion is equipped with a cutter 7 provided with a saw-tooth edge.

A wrapping film 8 wound cylindrically is contained in the box 2. The film 8 is pulled out from the opening 3 of the box 2 to the front of the front panel 6 by a desired length. Then, the pulled out film 8 is cut by the cutter 7 mounted in the end of the front flange 5.

Mounted on the front panel 6 of the box 2 is adhesively retaining device 10 which prevents the leading edge of the film left after the pulled out film 8 has been cut by the cutter 7 from being wound back into the box 2.

Figure 3:
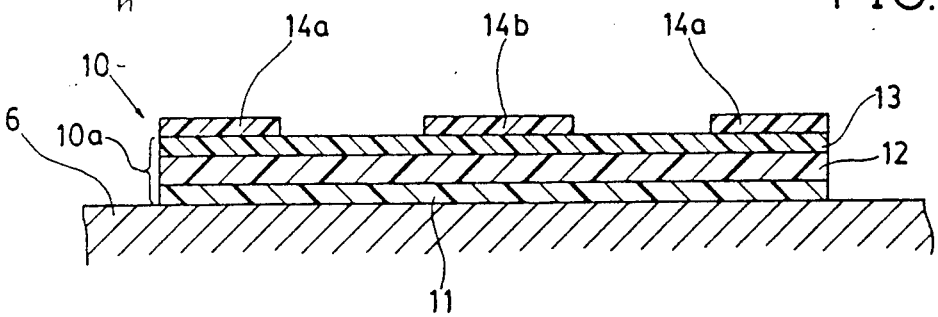
FIG. 3 is an enlarged sectional view of the retaining device.

As shown in FIG. 3, the adhesive retaining device 10 is basically formed of a laminated member 10*a* composed of three layers. The laminated member 10*a* includes a sticking layer 11, a base member 12 and an adhesive layer 13 successively from the surface of the front panel 6 of the box 2. The sticking layer 11 serves to fix the laminated member 10*a* on the surface of the front panel 6 and possesses high tack. The adhesive layer 13 can retain the wrapping film on the surface thereof with moderate adhesive force even if adhesive layer adheres to and is released from the film many times repeatedly and possesses low tack. As the whole structure of the adhesive retaining device 10, the surface of the adhesive layer 13 which is the uppermost layer thereof is partially covered by resin layers 14*a* and 14*b* made of, for example, ultraviolet radiation cure type ink.

Material of the layers is as follows.

Actual material of the base member 12 is resin film such as polyester, polyethylene, polypropylene, polyvinyl chloride, or paper, paper impregnated with resin, synthetic paper, polyethylene laminated paper, polypropylene laminated paper and the like.

The sticking layer 11 serves to fix the base member 12 on the front panel 6 of paper strongly, and acrylic type pressure sensitive adhesive agent or rubber type pressure sensitive adhesive agent, for example, are used as material of the sticking layer 11.

There is used material for the adhesive layer 13 having tack and retaining force which are not reduced even after the adhesive layer adheres to and is released from the film repeatedly. Further, the adhesive layer 13 does not affix or retain the wrapping film 8 strongly but exhibits tack and retaining force to the extent that the wrapping film 8 can be prevented from being wound back or withdrawn back into the box 2. The adhesive layer 13 is formed of grafted copolymer obtained by graft-polymerizing vinyl chloride monomer with copolymer of ethylene and vinylacetate.

The laminated member 10*a* formed of three layers of the sticking layer 11, the base member 12 and the adhesive layer 13 can be used sufficiently for the purpose of the adhesively retaining device for preventing the film from being wound back into the carton. In the illustrated embodiment, however, the surface of the adhesive layer 13 is partially covered by the resin layers 14*a* and 14*b* such as ultraviolet radiation cure type ink. Since the surface of the adhesive layer 13 is partially covered by the resin layers 14*a* and 14*b*, the diameter of the surface of the adhesive layer 13 can be set so that the area of the adhesive surface of the layer 13 is slightly small while ensuring the area which is large to the extent that the wrapping film is apt to be pressed on the adhesive surface. By making the area of the adhesive surface smaller than the whole area of the adhesively retaining device, it can be prevented that the wrapping film 8 is retained by the adhesive layer 13 unnecessarily strongly and the force of retaining the film can be moderate. Ink for print such as ultraviolet radiation cure type ink colored to, for example, green is used as the resin layers 14*a* and 14*b*. Further, the film retaining device mounted to the dispensing carton body is not limited to only one.

Description is now made to a method of measuring the force of retaining the wrapping film by the adhesive surface of the adhesive layer 13 and an actual manufacturing method of the laminated member 10*a* composed of the sticking layer 11, the base member 12 and the adhesive layer 13.

The retaining force by the adhesive layer 13 hereinafter means that measured by the following measuring method.

MEASURING METHOD OF RETAINING FORCE

The laminated member 10*a* of the three-layer structure which is not provided with the resin layers 14*a* and 14*b* shown in FIG. 3 and is not attached to the carton box is cut into a rectangle having a width of 25 mm and a length of 60 mm as a sample. The adhesive surface of the adhesive layer 13 of this sample is pressed on the wrapping film (trade name "KREWRAP" of Kureha Chemical Industry Company) made of vinylidene chloride in the atmosphere of a temperature of 20° C. and a relative humidity of 65% by means of a roll having a weight of 2 kg and is affixed thereon. The sample affixed on the film is then left in a room temperature for 24 hours and thereafter is subjected to aging in the atmosphere of a temperature of 20° C. and a relative humidity of 65% for thirty minutes. Then, the rectangular laminated member 10*a* is peeled off from the film by means of an Instron type tension tester "TENSILON" on condition that a peeling off speed is 300 mm/min and a peeling off angle with respect to the adhesive surface is 180 degrees. The resistant force to the peeling off of the member from the film at this time is measured and expressed in unit of gram per 25 mm. The measurement is performed under the environment of a temperature of 20° C. and a relative humidity of 65%.

A manufacturing method of the three-layer laminated member is now described.

MANUFACTURING METHOD-1

The composition of the adhesive layer 13 is as follows:

(1) Graftmer—100 parts by weight (The graftmer is a grafted copolymer obtained by graft-polymerizing vinyl chloride monomer having weight ratio of 50 with copolymer of ethylene and vinylacetate having weight ratio of 50 in which the weight ratio of ethylene and vinylacetate is 55 to 45.)

(2) Stearic acid—0.5 parts by weight (3) Zinc stearate—0.7 parts by weight (4) Barium stearate—0.7 parts by weight The substances described in the item (2) et seq. are auxiliary agents required in the manufacturing method using a calender. The stearic acid is a lubricant, and the zinc stearate and the barium stearate are stabilizing agents.

The compositions are mixed by a banbury mixer to prepare a constitution or compound. Then, the compound is formed into sheet having a thickness of 60 μm by a calender under a temperature of 140° to 150° C. and the sheet is affixed to polyester film (base member 12) having a thickness of 50 μm to form the adhesive layer 13. Acrylic type pressure sensitive adhesive agent is applied on the other surface of the polyester film (base member 12) to form the sticking layer 11.

The force of retaining the film by the adhesive surface of the adhesive layer 13 manufactured by the above method was 25 grams per 25 mm with the measuring method described above.

MANUFACTURING METHOD-2

The composition of the adhesive layer 13 is as follows:

(1) Graftmer—100 parts by weight (The graftmer is a grafted copolymer obtained by graft-polymerizing vinyl chloride monomer having weight ratio of 70 with copolymer of ethylene and vinylacetate having weight ratio of 30 in which the weight ratio of ethylene and vinylacetate is 55 to 45.)

(2) Stearic acid—0.5 parts by weight (3) Zinc stearate—0.7 parts by weight (4) Barium stearate—0.7 parts by weight The above compositions was used to manufacture the laminated member 10*a* by the same method and conditions as those of the manufacturing method 1. The force of retaining the film by the adhesive surface of the adhesive layer 13 manufactured above was 7 grams per 25 mm with the measuring method described above.

MANUFACTURING METHOD-3

The composition of the adhesive layer 13 is as follows:

(1) Graftmer—100 parts by weight (The graftmer is a grafted copolymer obtained by graft-polymerizing vinyl chloride monomer having weight ratio of 40 with copolymer of ethylene and vinylacetate having weight ratio of 60 in which the weight ratio of ethylene and vinylacetate is 55 to 45.)

(2) Stearic acid—0.5 parts by weight (3) Zinc stearate—0.7 parts by weight (4) Barium stearate—0.7 parts by weight The above compositions was used to manufacture the laminated member 10*a* by the same method and conditions as those of the manufacturing method 1. The force of retaining the film by the adhesive surface of the adhesive layer 13 manufactured above was 38 grams per 25 mm with the measuring method described above.

MANUFACTURING METHOD-4

The composition of the adhesive layer 13 is as follows:

(1) Graftmer—100 parts by weight (The graftmer is a grafted copolymer obtained by graft-polymerizing vinyl chloride monomer having weight ratio of 50 with copolymer of ethylene and vinylacetate having weight ratio of 50 in which the weight ratio of ethylene and vinylacetate is 55 to 45.)

(2) Methyl ethyl ketone—200 parts by weight (3) Tetrahydrofuran—100 parts by weight (4) Toluene—100 parts by weight The substances described in the items (2) to (4) are solvents required to laminate layers by coating.

Resin solution for manufacturing the adhesive layer 13 was prepared using the above compositions. Then, the resin solution was applied on polyester film (base member 12) having a thickness 50 μm to form the adhesive layer 13 having a thickness 25 μm. Acrylic type pressure sensitive adhesive agent was applied on the other surface of the polyester film (base member 12) to form the sticking layer 11.

The force of retaining the film by the adhesive surface of the adhesive layer 13 of the laminated member 10*a* manufactured above was 22 grams per 25 mm with the measuring method described above.

MANUFACTURING METHOD-5

The composition of the adhesive layer 13 is as follows:

(1) Graftmer—100 parts by weight (The graftmer is a grafted copolymer obtained by graft-polymerizing vinyl chloride monomer having weight ratio of 60 with copolymer of ethylene and vinylacetate having weight ratio of 40 in which the weight ratio of ethylene and vinylacetate is 55 to 45.)

(2) Methyl ethyl ketone—200 parts by weight (3) Tetrahydrofuran—100 parts by weight (4) Ethyl acetate—150 parts by weight The substance described in the item (4) is also solvents required to laminate layers by coating.

Resin solution of the above compositions was used to manufacture the laminated member 10*a* using the same method as the manufacturing method 4. The force of retaining the film by the adhesive surface of the adhesive layer 13 manufactured above was 6 grams per 25 mm with the measuring method described above.

MANUFACTURING METHOD 6

The composition of the adhesive layer 13 is as follows:

(1) Graftmer—100 parts by weight (The graftmer is a grafted copolymer obtained by graft-polymerizing vinyl chloride monomer having weight ratio of 30 with copolymer of ethylene and vinylacetate having weight ratio of 70 in which the weight ratio of ethylene and vinylacetate is 55 to 45.)

(2) Methyl ethyl ketone—200 parts by weight (3) Tetrahydrofuran—100 parts by weight (4) Toluene—100 parts by weight Resin solution of the above compositions was used to manufacture the laminated member 10*a* using the same method as the manufacturing method 4. The force of retaining the film by the adhesive surface of the adhesive layer 13 of the retaining device manufactured above was 35 grams per 25 mm with the measuring method described above.

Figure 2:
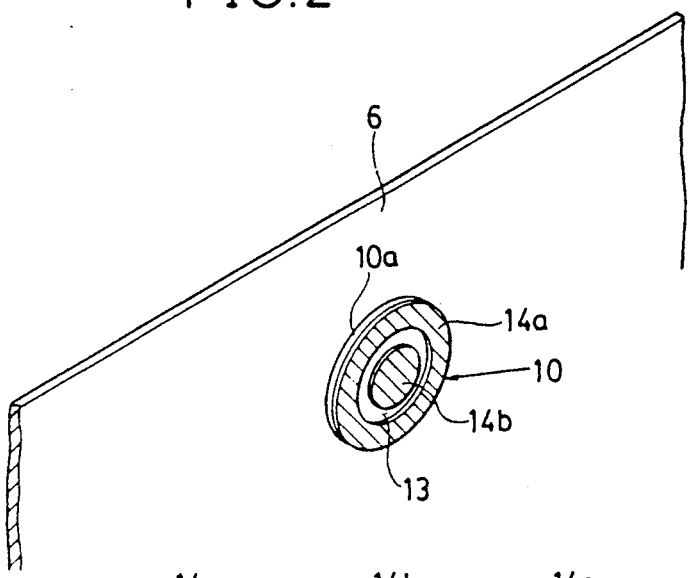
FIG. 2 is a perspective view showing a retaining device provided in the dispensing carton in an enlarged manner.
Figure 5:
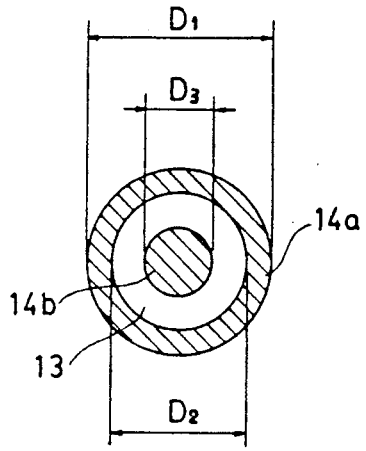
FIGS. 5, 6, 7 and 8 are front views of retaining devices according to various embodiments.

Resin layers 14*a* and 14*b* in the form of a double circle shown in FIG. 5 were printed on the surface of the adhesive layer 13 of the three-layer laminated member 10*a* manufactured by the above manufacturing methods 1 to 6. The size of the area of the resin layers 14*a* and 14*b* is $D_1=14$ mm, $D_2=10$ mm, and $D_3=6$ mm. The resin layers 14*a* and 14*b* are formed of green ultraviolet radiation cure type ink. The retaining device 10 obtained by printing the resin layers 14*a* and 14*b* on the surface of the three-layer laminated member 10*a* manufactured by the above methods adhered to or was attached on the front panel 6 of the carton containing the "KREWRAP" as shown in FIG. 2. This carton was used to perform a test of repeated adhesion and separation of the wrapping film to the retaining device 10 under a room temperature. In this test, the surface of the KREWRAP brought into contact with the surface of the retaining device 10 was replaced with a new surface thereof for each adhesion and separation. Consequently, it has been found that all samples manufactured by the above manufacturing methods 1 to 6 can attain repeated adhesion and separation 500 times or more and endurable for actual use. Further, it has been confirmed by the test that the force of retaining the wrapping film by the surface of the resin layers 14*a* and 14*b* of ultraviolet radiation cure type ink printed on the surface of the retaining device 10 is extremely weak as compared with the force of retaining the film by the adhesive surface of the adhesive layer 13. During the test, the sticking layer 11 was not peeled off from the front panel 6 of the carton box.

In order to explain the effects of the present invention, a comparison sample described below was manufactured to perform measurement and test to be described.

COMPARISON SAMPLE

A laminated member was manufactured by the same method as the manufacturing method 4. In this manufacturing method, however, the graftmer was a grafted copolymer obtained by graft-polymerizing vinyl chloride monomer having weight ratio of 10 with copolymer of ethylene and vinylacetate having weight ratio of 90 in which the weight ratio of ethylene and vinylacetate is 55 to 45. Other composition ratio is the same as that of the manufacturing method 4. The force of retaining the wrapping film by the adhesive layer 13 of the laminated member 10*a* manufactured in this manner was measured by the above-mentioned measuring method. However, the wrapping film was broken during the measurement. A measured value of the retaining force before the film was broken was 55 grams per 25 mm.

In the present invention, the laminated member 10*a* may be manufactured by another method, for example, the extrusion method. That is, the sticking layer 11 and the adhesive layer 13 can be extruded onto both surfaces of the base member 12 by the extrusion method to form the laminated member. Alternatively, layers may be affixed to each other.

A method of forming the resin layers 14*a* and 14*b* is now described.

The resin layers 14*a* and 14*b* shown in the embodiment are formed in a printing process. Printing ink such as ultraviolet radiation cure type ink is used as resin material for the resin layers 14*a* and 14*b*. Green resin layers can be formed by using both of "FDO-indigo-G" and FDO-yellow-G" of ultraviolet radiation cure type ink manufactured by Toyo Ink Manufacturing Company, for example. Color is not limited to green but red, indigo, green or others may be used. The three-layer laminated member 10*a* prepared by the manufacturing method is transferred to a printing process while silicone glassine exfoliation paper, for example, is attached to the surface of the sticking layer 11. In the printing process, the ink is offset printed on the surface of the adhesive 13 of the laminated member 10*a* and is instantaneously cured by a ultraviolet radiation apparatus so that the resin layers 14*a* and 14*b* of green pattern is formed. After the printing process, the laminated member 10*a* is trimmed from the outer periphery of the resin layer 14*a* and the retaining device as shown in FIG. 3 is formed.

As described above, a contact area of the adhesive surface of the adhesive layer 13 and the wrapping film 8 is adjusted by forming the resin layers 14*a* and 14*b* so that the force of retaining the film is moderate. A proper size of the resin layers 14*a* and 14*b* is, for example, about $D_1=14$ mm, $D_2=10$ mm and $D_3=6$ mm in FIG. 5. These dimensions are properly set in accordance with tack and the retaining force of the adhesive surface of the adhesive layer 13. That is, the dimensions may be properly set in accordance with the retaining force of the adhesive layer 13 manufactured by each of the manufacturing methods.

Figure 6:
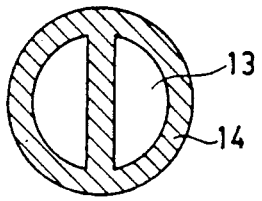
Figure 7:
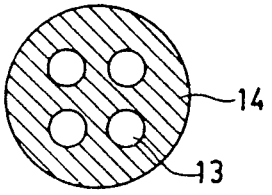
Figure 8:
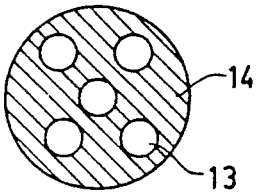

Various printing patterns of the resin layers are considered as shown by 14 of FIGS. 6 to 8. In any case, the area of the adhesive surface of the adhesive layer 13 can be properly set by the resin layer 14 in accordance with the retaining force of the adhesive layer 13 so that the force of retaining the wrapping film can be adjusted to an optimum value.

Figure 4:
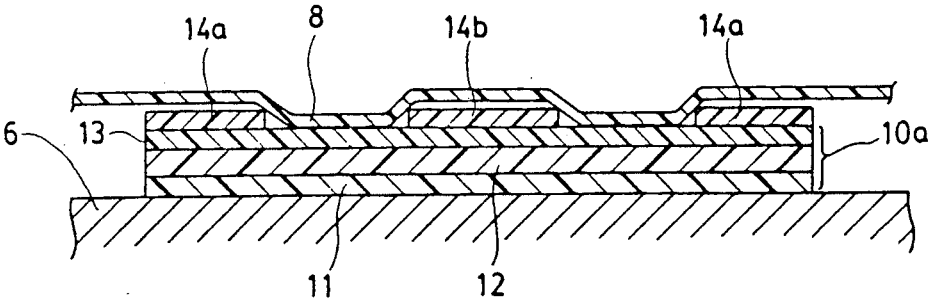
FIG. 4 is an enlarged sectional view showing the retaining device to which a wrapping film is retained.

When the adhesive layer 13 of the retaining device 10 manufactured by the manufacturing methods 1 to 6 is used, the force of retaining the wrapping film, for example, trade name "KREWRAP" of polyvinylidene chloride manufactured by Kureha Chemical Industry Company is less than about 50 grams per 25 mm and can retain the wrapping film 8 left after the pulled out film has been cut by the cutter 7 shown in FIG. 1 sufficiently to prevent the film from being wound back into the box 2. Further, as shown in FIG. 4, by adjusting the contact area of the adhesive layer 13 and the wrapping film 8 by the resin layers 14*a* and 14*b*, the force of retaining the wrapping film is moderate. On the other hand, since the retaining force or adhesive force of the surface of the adhesive layer 13 is adjusted to a small value, fiber of paper which is material of the front flange 5 or dust does not adhere to the adhesive layer 13 even if the inner surface of the front flange 5 comes into contact with the retaining device 10 when the wrapping film 8 is not pulled out yet. Accordingly, it is difficult to deteriorate the retaining force of the adhesive layer 13 as it ages. Particularly, when the resin layers 14*a* and 14*b* are provided, since the front flange 5 comes into contact with the surface of the resin layers 14*a* and 14*b* and the front flange 5 does not come into contact with the adhesive layer 13 directly, fiber of paper does not quite adhere to the adhesive layer 13. Accordingly, even if the inner surface of the front flange 5 is in contact with the retaining device 10 before the dispensing carton is opened by the user, the retaining force of the adhesive layer 13 is not reduced. Thus, it is not necessary to provide a protection sheet such as exfoliation paper on the inner surface of the front flange 5 on which the retaining device 10 hangs.

Further, the retaining force or the adhesive force of the adhesive layer 13 manufactured by the manufacturing methods 1 to 6 is not reduced extremely even if the adhesive layer 13 adheres to and is released from the wrapping film such as "KREWRAP" repeatedly. Accordingly, each time the wrapping film 8 is pulled out from the carton and is cut, the film 8 left after the film has been cut is retained by the retaining device 10 exactly at all times.

As shown in FIGS. 1, 2 and 5, when the planar shape of the resin layers 14*a* and 14*b* is formed into a double circle and the resin layer 14*b* is colored to, for example, green, this resin layer serves as a detection target for various sensors in the manufacturing process of the carton.

Further, as shown in FIG. 3, in the case where the peripheral edge portion of the surface of the adhesive layer 13 is adapted to be covered by the resin layer 14*a*, even if the adhesive agent of the sticking layer 11 sticks to the peripheral edge portion, the wrapping film is not affixed or adhered to the adhesive agent of the sticking layer 11, since the peripheral edge portion is covered by the resin layer 14*a*.

As described above, according to the present invention, the adhesive layer of the retaining device possesses the properties that the adhesive layer adheres to the wrapping film but is difficult to adhere to paper of the carton and can adhere to and be released from the film repeatedly. Accordingly, the adhesive layer can retain the wrapping film left after the pulled out film has been cut many times repeatedly. Further, since it is difficult that fiber of paper or dust adheres to the adhesive layer, the adhesive capability of the adhesive layer is not deteriorated as it ages. Since dust is not transferred from the adhesive layer to the wrapping film, it is clean.

Further, by partially covering the surface of the adhesive layer by resin such as ultraviolet radiation cure type ink, the surface area of the adhesive layer which adheres to the wrapping film can be made small and the force of retaining the film by the adhesive layer can be adjust to the optimum. The resin layer can be colored and formed into a double circle so that the resin layer can serves as a detection target for various sensors. Thus, in the manufacturing process, the printed portion can be used to detect whether the film retaining device is attached in place or not.

We claim:

1. A dispensing carton containing film wound cylindrically comprising a box including a bottom panel, a rear panel, a front panel and both side panels, a lid member joined to said rear panel to cover an upper opening of said box, a cutter for cutting the film pulled out from said opening, and adhesive retaining means disposed on a front surface of said front panel, said adhesive retaining means including a base member, a sticking layer mounted on one surface of said base member to fix said base member on the surface of said front panel, an adhesive layer mounted on an other surface of said base member on which the film left after the pulled out film has been cut by said cutter hands and a resin layer mounted on a partial surface of said adhesive layer, a force of retaining said film by a surface of said resin layer is weak as compared with a force of retaining said film by the surface of said adhesive layer.

2. A dispensing carton according to claim 1, wherein said adhesive layer is formed of grafted copolymer obtained by graph-polymerizing vinyl chloride monomer with a copolymer of ethylene and vinylacetate.

3. A dispensing carton according to claim 1, wherein said resin layer comprises printing ink.

4. A dispensing carton according to claim 1, wherein said resin layer comprises ultraviolet radiation cure type printing ink.

5. A dispensing carton according to claim 1, wherein said resin layer is colored.

6. A dispensing carton according to claim 1, wherein said retaining means includes a planar shape formed into a circle and said resin layer covering the surface of said adhesive layer includes a ring portion covering an edge of the surface of said adhesive layer and a circular portion covering a center of the surface of said adhesive layer.

* * * * *